US009156585B2

(12) United States Patent
Neiner

(10) Patent No.: US 9,156,585 B2
(45) Date of Patent: Oct. 13, 2015

(54) DOUBLE OPENING BEVERAGE CAN LID SYSTEM

(71) Applicant: Anheuser-Busch InBev, SA, Brussels (BE)

(72) Inventor: Christopher G. Neiner, Newtown, PA (US)

(73) Assignee: ANHEUSER-BUSCH InBEV S.A., Brussels (BM)

( * ) Notice: Subject to any disclaimer, the term of this patent is extended or adjusted under 35 U.S.C. 154(b) by 19 days.

(21) Appl. No.: 13/907,335

(22) Filed: May 31, 2013

(65) Prior Publication Data

US 2013/0264343 A1 Oct. 10, 2013

Related U.S. Application Data

(63) Continuation-in-part of application No. 13/598,318, filed on Aug. 29, 2012, now Pat. No. 8,783,496.

(60) Provisional application No. 61/620,027, filed on Apr. 4, 2012.

(51) Int. Cl.

| | |
|---|---|
| ***B65D 17/34*** | (2006.01) |
| ***B65D 17/00*** | (2006.01) |
| ***B21D 51/26*** | (2006.01) |
| ***B21D 51/38*** | (2006.01) |

(52) U.S. Cl.

CPC ..... *B65D 17/163* (2013.01); *B21D 51/26* (2013.01); *B21D 51/383* (2013.01); *B65D 17/165* (2013.01); *B65D 2517/0094* (2013.01)

(58) Field of Classification Search

CPC ..... B65D 17/163; B65D 17/165; B65D 51/1677; B65D 17/00; B65D 17/32; B65D 17/35

USPC ..... 220/254.6, 260, 265, 266, 269, 270, 220/272, 273, 367.4, 379; 215/255, 215/381–385; 222/153.07, 481, 482, 541.9, 222/541, 543, 545

See application file for complete search history.

(56) References Cited

U.S. PATENT DOCUMENTS

| | | | |
|---|---|---|---|
| 3,420,398 | A | 1/1969 | Chun |
| 3,441,169 | A | 4/1969 | Dunn et al. |
| 4,136,797 | A | 1/1979 | Potts |
| 4,865,215 | A | 9/1989 | Wells |
| 4,872,597 | A | 10/1989 | Hanafusa |

(Continued)

FOREIGN PATENT DOCUMENTS

| | | |
|---|---|---|
| CA | 2280461 A1 | 2/2001 |
| JP | 10245032 | 9/1998 |

(Continued)

*Primary Examiner* — Fenn Matthew
*Assistant Examiner* — Elizabeth Volz
(74) *Attorney, Agent, or Firm* — Gardere Wynne Sewell LLP

(57) ABSTRACT

The embodiments disclosed describe a double opening beverage can lid system. The system includes a can lid having a pour panel associated with a pour opening and a vent panel associated with a vent opening. A tab is attached to the can lid. The tab includes a primary tab portion configured to open the pour opening, and a secondary tab portion configured to open the vent opening. A rivet hole facilitates attachment of the primary tab portion and the secondary tab portion to the can lid. A shelf is bent about 180° around a rear edge of the primary tab portion. The shelf blocks at least a portion of the secondary tab portion from contacting the vent panel.

19 Claims, 5 Drawing Sheets

(56) References Cited

U.S. PATENT DOCUMENTS

| | | | |
|---|---|---|---|
| 5,011,037 | A | 4/1991 | Moen et al. |
| 5,397,014 | A | 3/1995 | Aydt |
| 5,695,085 | A | 12/1997 | Hadener |
| 6,112,932 | A | 9/2000 | Holdren |
| 6,131,763 | A | 10/2000 | Stanish et al. |
| 6,202,880 | B1 | 3/2001 | Strube et al. |
| 6,981,608 | B2 | 1/2006 | Battmer |
| 8,245,866 | B2 | 8/2012 | Gibson et al. |
| 2003/0189045 | A1 | 10/2003 | Hwang |
| 2005/0173437 | A1 | 8/2005 | Hwang |
| 2011/0108552 | A1* | 5/2011 | Tamarit Rios ..... 220/269 |

FOREIGN PATENT DOCUMENTS

| | | | |
|---|---|---|---|
| NL | 1023297 | C1 | 11/2004 |
| WO | WO-2008023983 | A1 | 2/2008 |

* cited by examiner

DOUBLE OPENING BEVERAGE CAN LID SYSTEM

CROSS-REFERENCE TO RELATED APPLICATIONS

The application is a continuation-in-part application of U.S. patent application Ser. No. 13/598,318, filed on Aug. 29, 2012, and titled Improved Double-Opening Can Lid, which claims priority to U.S. Provisional Patent Application Ser. No. 61/620,027 filed on Apr. 4, 2012, the disclosures of each of which are hereby incorporated by reference.

TECHNICAL FIELD

The present invention generally relates to closure systems for beverage containers, and more specifically to a lid and tab assembly providing a double opening in a beverage can lid.

BACKGROUND OF THE DISCLOSURE

Beverage containers or cans generally have a lid having a score line or lines defining a tear panel which is opened when a riveted tab pushes in the tear panel when the back of the tab is raised and thereby creates the primary opening of the can.

The primary or pour opening in many known designs, in addition to being the exit for the liquid in the can, is also the entrance for air to replace the exiting liquid. This dual use of the primary opening interferes with smooth pouring of the liquid contents. Accordingly, there have been many attempts, mostly unsuccessful, to provide a second, vent opening or tear panel and a convenient means or apparatus for opening both the pour and vent tear panels.

U.S. Patent Publication No. 2011/0108552 to Tamarit Rios discloses a method and apparatus for opening both a pour opening and a vent opening on a beverage can using a single pull tab. The Tamarit Rios invention may be improved upon, particularly with regard to design for manufacture and other refinements and optimizations.

SUMMARY

Accordingly, the embodiments disclosed describe a double opening beverage can lid system. The system includes a can lid having a pour panel associated with a pour opening and a vent panel associated with a vent opening. A tab is attached to the can lid. The tab includes a primary tab portion configured to open the pour opening, and a secondary tab portion configured to open the vent opening. A rivet hole facilitates attachment of the primary tab portion and the secondary tab portion to the can lid. A shelf is bent about 180° around a rear edge of the primary tab portion. The shelf blocks at least a portion of the secondary tab portion from contacting the vent panel.

Embodiments disclosed also describe a method of manufacturing a tab for a double opening can lid. From a sheet of material a primary tab portion, a secondary tab portion, and a shelf are formed. The shelf extends from an end of the primary tab portion and is bent about 180° to be disposed underneath at least part of the secondary tab portion.

The system and method may also include a skirt that is formed from the sheet of material and extends from a head of the secondary tab portion. The skirt is configured to contact a vent panel of the can lid and fracture it along a vent score to create the vent opening.

Technical advantages of the double opening beverage can lid system disclosed include a tab for which operation is similar to conventional stay-on tabs. Lifting the tab such that the tab acts as a lever to create the pour opening simultaneously positions the tab to perform the vent opening operation because a shelf on the primary tab is in position to direct the secondary tab downward to contact the vent panel and create a vent opening.

Further technical advantages include a shelf on the tab that may be consistently manufactured, and when assembled to the can lid, the shelf blocks the opening features of the secondary tab from contacting the vent panel. This blocking by the shelf allows the beverage can to be shipped, stacked, handled, and the like without unintentionally creating the vent opening.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
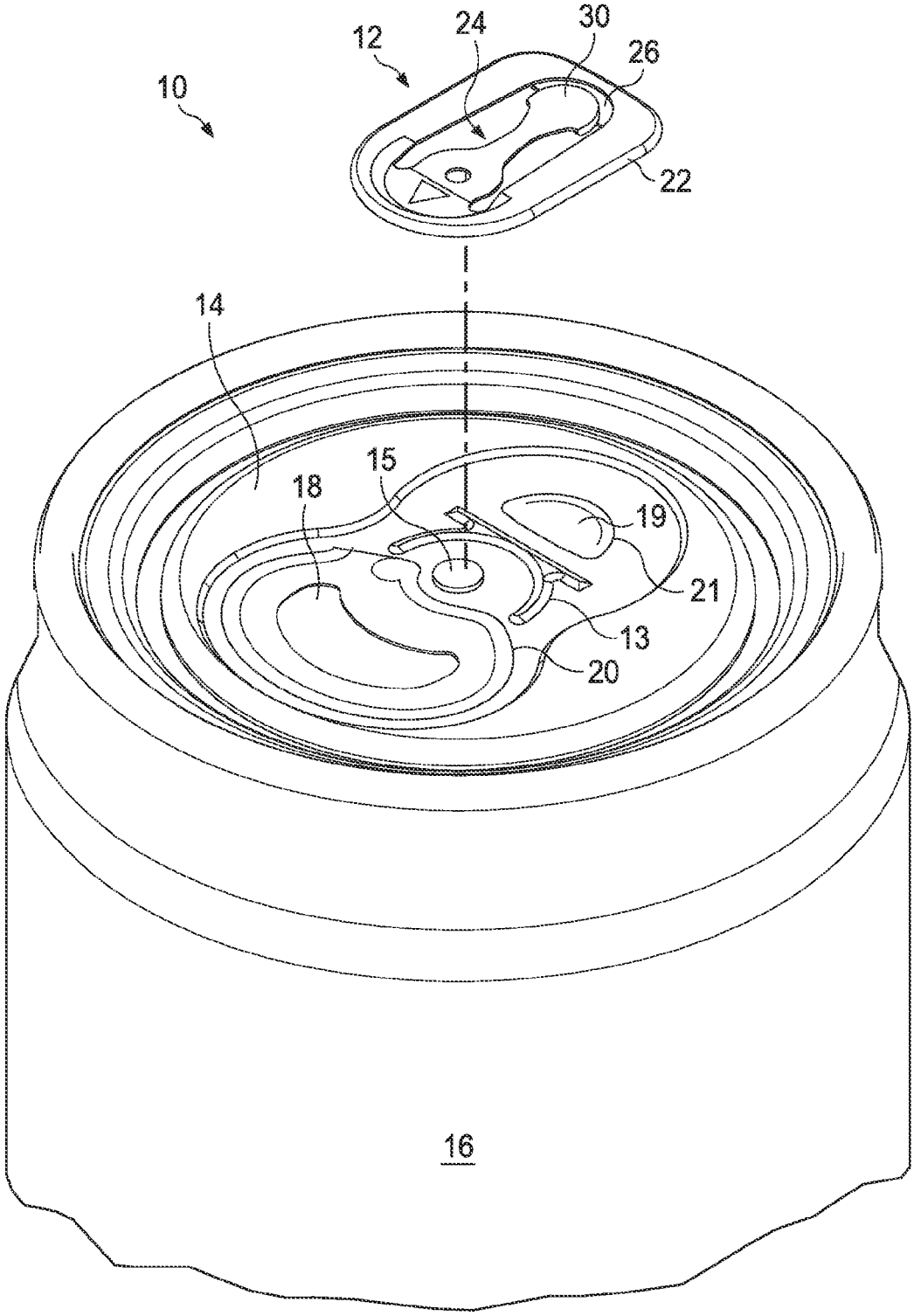
FIG. 1 is an isometric view of a portion of a beverage can including a double-opening lid system showing an exploded tab in accordance with this disclosure.

Referring now to the drawings, a double-opening beverage can lid system 10 is depicted in FIG. 1. The can lid assembly 10 includes a tab 12 secured to a double-opening lid 14 by a rivet 15 and crimped to a beverage can 16. The can 16, lid 14, and tab 12 are each made of aluminum or an aluminum alloy. However, any suitable material for manufacturing beverage cans may be used according to the teaching of the present disclosure, such as steel, or tin plated steel. The lid 14 is crimped to a top portion of the beverage can 16 after the can 16 is filled with a beverage, which may be a carbonated soft drink, an alcoholic beverage, such as beer, a fruit juice, tea, energy drink and the like. The lid 14 includes a pour panel 18 that is configured to fracture from the rest of the lid 14 along a pour score 20. The rear of the tab 12 is lifted and the tab functions as a lever with the rivet 15 at the fulcrum. The tab 12 applies a downward force to the pour panel 18 causing it to separate from the lid 14 along the pour score 20 and further bends the pour panel 18 into the can 16 and out of the way of the resulting pour opening.

According to embodiments of the present disclosure, the tab 12 includes a primary tab portion 22 and a secondary tab portion 24. The primary tab portion 22 functions as the lever previously described and serves to fracture the pour panel 18 from the lid 14 to create the pour opening 17 (see FIGS. 4A-4D). The secondary tab portion 24, as described in more detail below, is configured to create a vent opening 25 (see FIG. 4D) by fracturing a vent panel 19 along a vent score 21. The tab 12 also includes a shelf 26 which provides a barrier between a head 30 of the secondary tab portion 24 and the vent panel 19. When the lid assembly is closed, as shown in FIG. 1, the shelf 26 prevents unintended opening of the vent panel 19 during shipping and handling of the beverage can 16 because it blocks the opening features of the secondary tab 24 from contacting the vent panel 19. In addition, a lid projection 13 may also serve to maintain the secondary tab 24 elevated above the vent panel 19.

Figure 2:
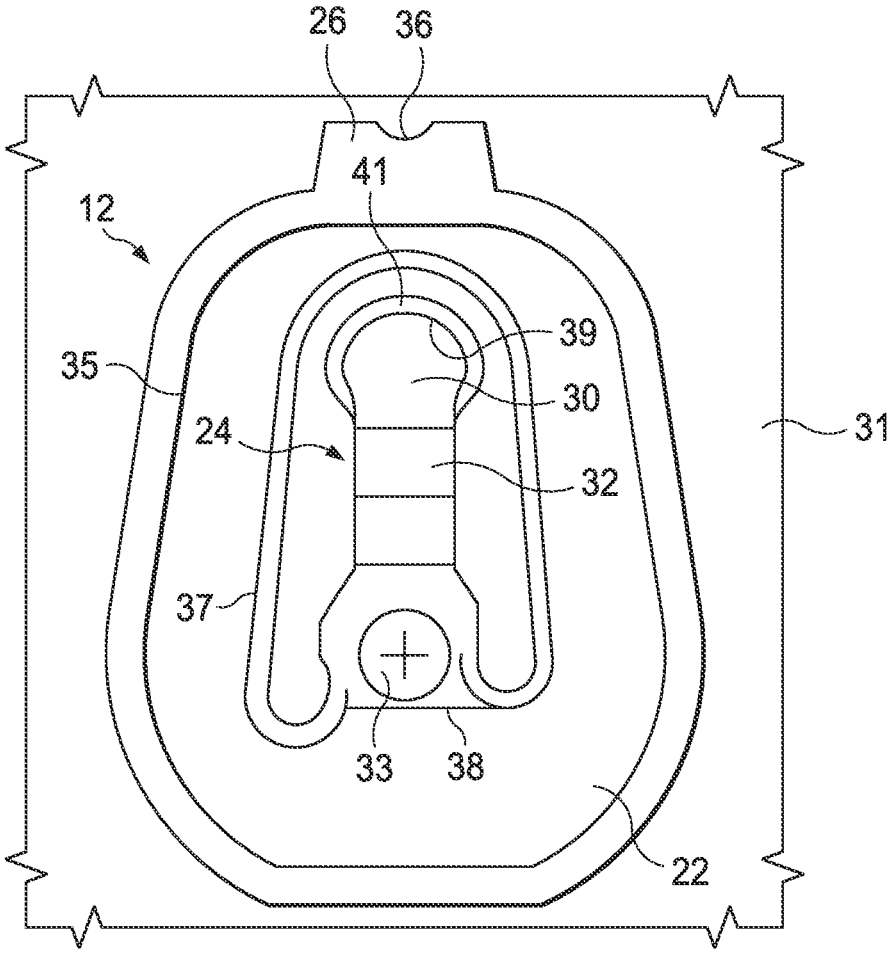
FIG. 2 is a top view of a partially formed tab in accordance with the present disclosure.

Reference is now made to FIG. 2, which shows a partially formed tab 12. Many tabs 12 are formed from a single sheet of material 31, typically aluminum, that is stamped, folded, coined, scored, and/or subjected to other sheet metal forming operations. For illustration purposes, a rivet hole location 33 is indicated by a cross within a circle. In the illustrated embodiment, the partially formed tab 12 is generally flat and the portions of the tab that will become the primary tab 22, the secondary tab 24, and the shelf 26 are partially formed. The shelf 26 extends from an outer perimeter of the tab 12. In certain embodiments, a notch 36 is formed in the shelf 26. In one or more subsequent forming operations, the flat partially formed tab 12 will be folded along an outer perimeter fold line 35 and an inner perimeter fold line 37. Folding the tab 12 along the perimeter fold lines 35, 37 increases the rigidity of the tab 12 and positions the shelf 26 underneath the portions of the head 30 of the secondary tab 24 that will contact the vent panel 19 of the lid 14 when the full opening procedure is performed. In addition, the head 30 of the secondary tab portion 24 will be folded along a skirt fold line 39 to create the skirt 41 (see FIGS. 3C and 3D).

In an alternate embodiment, a strap 32 of the secondary tab portion 24 may be extended to increase its length such that the head 30 of the secondary tab 24 extends further over the shelf 26. Extending the length of the strap 32 may include reducing its thickness by processes that are known in the art of sheet metal forming. For example, end portions of the strap 32 may be fixed while the middle portion is subjected to deformation which will increase its length and reduce its thickness. In an alternate embodiment, the strap 32 may be coined to increase its length.

Figure 3A:
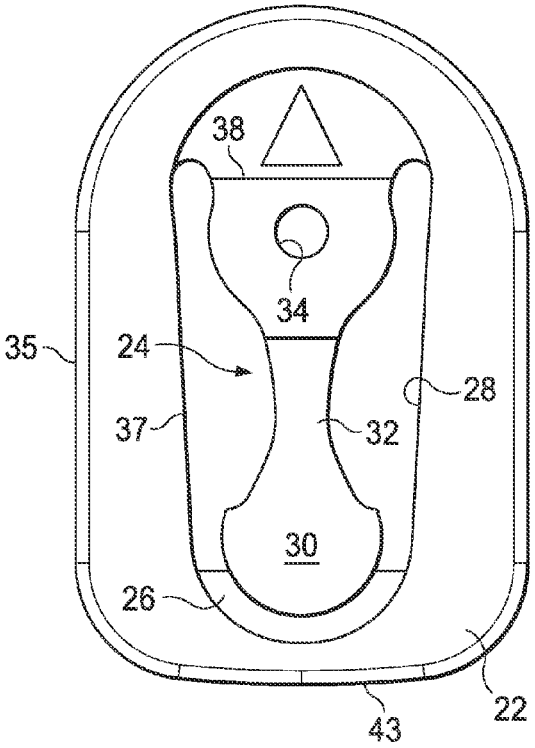
FIG. 3A is a top view of a tab of a double opening lid system in accordance with this disclosure.
Figure 3B:
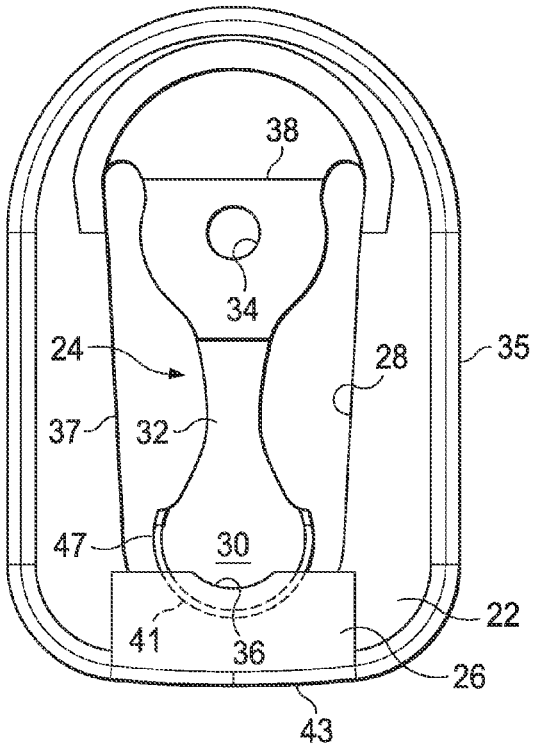
FIG. 3B is a bottom view of the tab of FIG. 3A.

Reference is made to FIGS. 3A and 3B, which illustrate a top view (FIG. 3A) and a bottom view (FIG. 3B) of the fully formed tab 12. The outer perimeter fold line 35 is now generally the outer perimeter edge of the primary tab 22, and the inner perimeter fold line 37 is now generally the inner perimeter edge of the primary tab 22 and defines a central opening 28 where the secondary tab portion 24 is located. The primary tab 22 is shaped and functions similar to a conventional tab for beverage cans. In addition, the primary tab 22 also includes the shelf 26 which has been folded underneath a rear portion of the primary tab 22 and is disposed underneath at least a part of the head 30 of the secondary tab portion 24. As previously described, the shelf 26 creates a barrier between the contacting portions of the secondary tab 24 and the vent panel 19 when the tab 12 is secured to the double-opening can lid 14. Creation of the shelf 26 by the folding process described also may create a rear edge 43 that is generally straight, as opposed to curved, as in some conventional tabs.

Figure 4A:
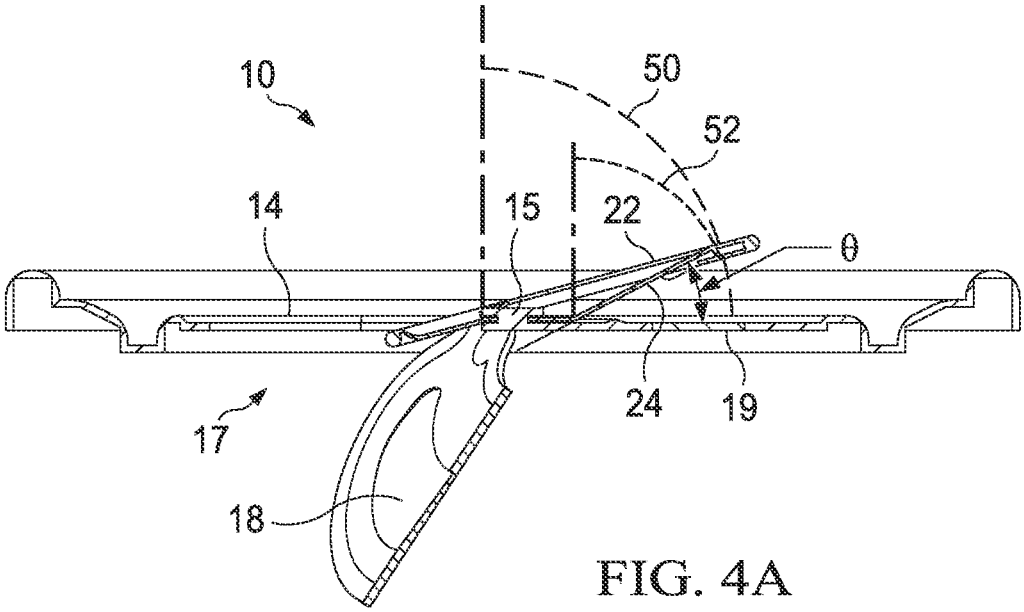
FIGS. 4A-4D are cross sections illustrating the double-opening can lid system in sequential stages of a double opening operation in accordance with the present disclosure.
Figure 4B:
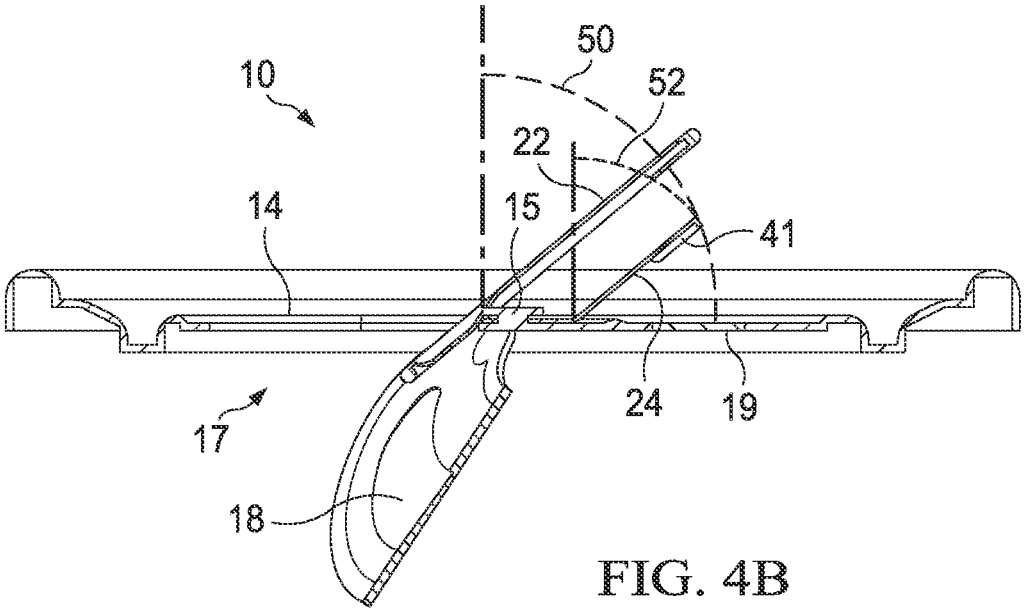

The shelf may also include the notch 36, which is a small cut-away portion in the center of the shelf 26. The notch 36 generally follows the rounded shape of the head 30 of the secondary tab 24. The notch 36 functions to allow the primary tab 22 to better separate from the secondary tab 24 when lifted past a certain release angle θ as shown in FIGS. 4A-4B. Including the notch 36 reduces the angle at which the secondary tab 24 separates from the primary tab 22 approximately 8°. Even though it serves to reduce the release angle, the notch 36 continues to allow the shelf 26 to depress the head 30 of the secondary tab 24 downward to create the vent opening.

It should be noted that the surface of the shelf 26 shown in FIG. 3B, which is a bottom view, is a top surface of the sheet of material 31 out of which the tab 12 is fabricated. Thus, the surface of the shelf 26 shown in FIG. 3A, which is a top view of the tab 12 is a bottom surface of the sheet of material 31 out of which the tab 12 is fabricated. This process may provide advantages over an alternate process of coining and thinning a portion of the primary tab 22 to create a similar feature to the shelf 26. For example, the shelf 26 is more easily and consistently manufactured and functions better as the barrier between the secondary tab 24 and the vent panel 19. The shelf 26 also functions better with respect to consistently performing the double-opening functionality of the system described in more detail with respect to FIGS. 4A-4D.

The secondary tab portion 24 includes the head 30 and a strap portion 32. The strap portion 32 extends from the head 30 toward a front portion of the tab 12. The secondary tab portion 24 also includes a rivet hole 34, which allows the tab 12 to be secured to the lid 14 by the rivet 15 using conventional tab/lid assembly processes. The strap portion 32 may be slightly contoured to reduce the material used and to facilitate an appropriate force that will bend and displace the secondary tab 24 during opening without fracturing it.

In certain embodiments, the tab 12 also includes a tab score 38. The tab score 38 allows the primary tab 22 to fracture and be separated from the secondary tab 24 at a controlled location. It should be noted that normal opening of the pour opening and the vent opening will not cause the tab 12 to fracture. However, it is possible that consumers may bend the tab 12 to intentionally cause the tab 12 to fracture, so a controlled fracturing point is desirable. Without the tab score 38, bending the tab to intentionally cause fracture can cause the tab 12 to fracture through the rivet hole 34, which may cause the primary tab 22 and the secondary tab 24 to separate from the lid 14. With the inclusion of the tab score 38, the primary tab 22 may be fractured and removed from the double-opening can lid assembly 10, while the secondary tab 24 continues to be riveted to the lid 14. In an alternate embodiment, the tab 12 does not include a tab score 38.

Figure 3C:
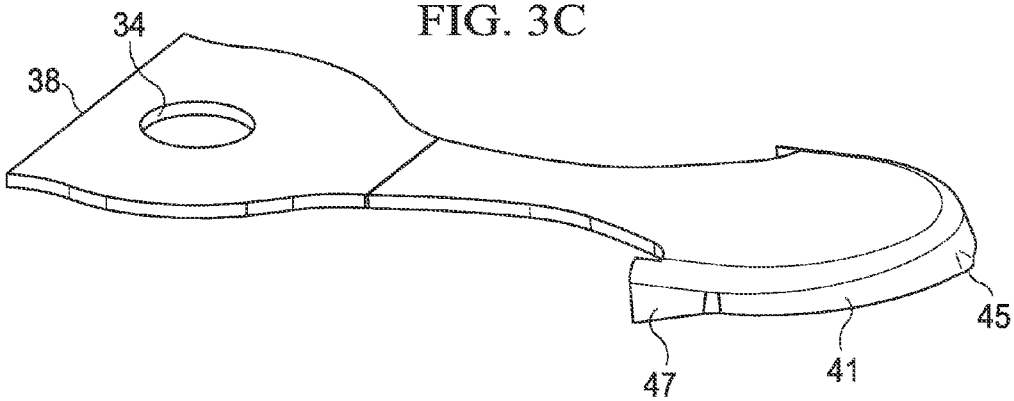
FIG. 3C is an isometric view of a secondary tab portion of the tab of FIGS. 3A and 3B.
Figure 3D:
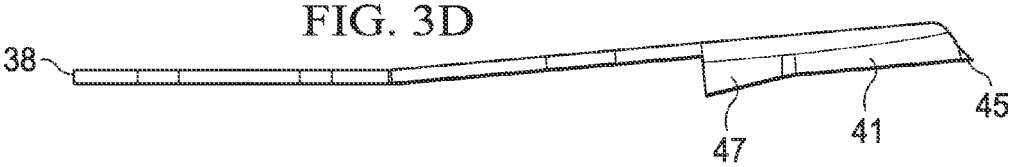
FIG. 3D is a side view of the secondary tab portion of FIG. 3C.

Reference is made to FIG. 3C, which is an isometric view of the secondary tab 24 separated from the primary tab 22 along the tab score 38, and 3D, which is a side view of the secondary tab 24. A primary contactor 45 or shark's tooth extends from the skirt 41 and is disposed in the middle of the head 30 of the secondary tab 24. The primary contactor 45 concentrates the force from the secondary tab 24 at a single point on the vent panel 19 to facilitate fracture along the vent score 21. After the initial fracture, the skirt 41 contacts the vent panel 19 and folds the vent panel 19 underneath the lid 14 and out of the way to create the vent opening 25 (see FIG. 4D). In certain embodiments, the skirt 41 may also include one or more secondary contactors 47. The secondary contactors 47 may be similar to the primary contactor 45 and may be disposed opposite the head 30 from each other. Similar to the primary contactor 45, the secondary contactors 47 concentrate the force applied by the skirt 41 to fracture and/or displace the vent tab 19. An alternate embodiment of the tab 12 for the double opening can system 10 of the present disclosure may include the skirt 41 without either the primary contactor 45 or the secondary contactor 47, or without both the primary contactor 45 and the secondary contactor 47.

Reference is now made to FIGS. 4A-4D, which illustrate a cross-section of the double-opening can lid assembly 10 in sequential stages of an opening operation. FIG. 4A shows the primary tab portion 22 and the secondary tab portion 24 having been lifted simultaneously. The secondary tab portion 24 is lifted by the shelf 26 as the consumer lifts the primary tab portion 22. The front of the primary tab portion 22 acts as a lever and fractures the pour panel 18 away from the rest of the lid 12 and displaces the pour panel 18 downward into the can to create the pour opening 17. The primary tab portion 22 follows a primary tab portion arc 50, and the secondary tab portion 24 follows a secondary tab portion arc 52. A pivot point of the primary tab portion 22 is located on an opposite side of the rivet 15 from the rear of the primary tab 22 that is lifted. The pivot point of the secondary tab portion 24 is located on the same side of the rivet 15 as the rear or head 30 of the secondary tab portion 24, which is lifted by the shelf 26. In this manner, the primary tab portion arc 50 will be different from the secondary tab portion arc 52.

As illustrated in FIG. 4A, the primary tab portion 22 and the secondary tab portion 24 will travel together through a certain angle before the secondary tab 24 releases and separates from the primary tab 22. The range of this release angle θ may be 15° to 35°. In a preferred embodiment, the range of the release angle θ is 22° to 27°, with approximately 26° being a target release angle θ. As previously stated, the release angle increases approximately 8° for a shelf 26 without a notch 36.

FIG. 4B illustrates the primary tab portion 22 and the secondary tab portion 24 at a greater opening angle than shown in FIG. 4A. The primary tab portion 22 is following its arc 50 and has separated from the secondary tab portion 24, which is following its arc 52. The separation may be facilitated by the notch 36 of the shelf 26.

Figure 4C:
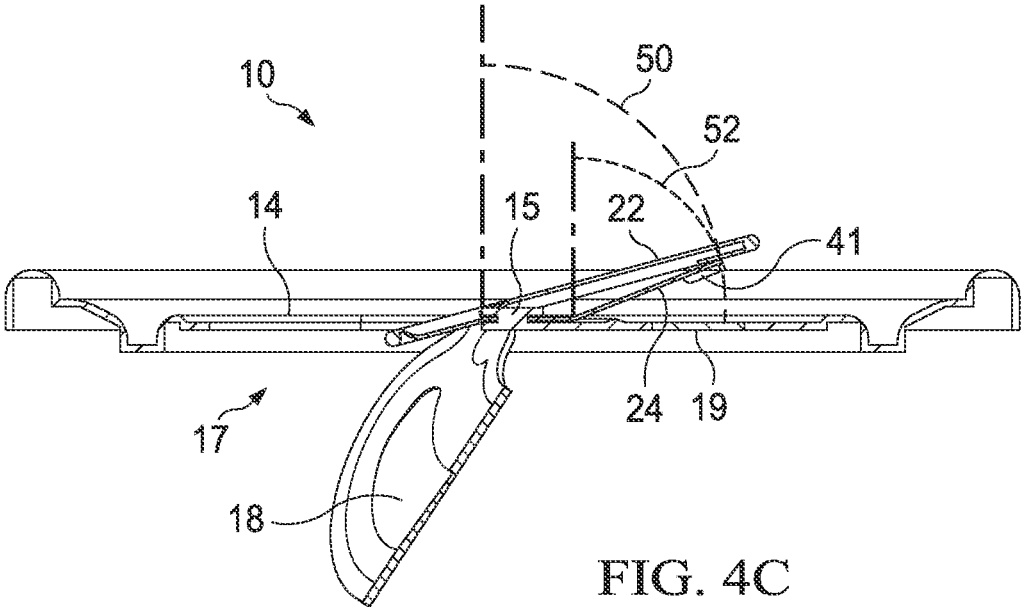

FIG. 4C illustrates the double-opening can lid assembly 10 as the consumer presses the primary tab portion 22 back towards the lid 14 after creating the pour opening 17. As shown, a bottom surface of the shelf 26 opposite the surface of the shelf 26 that lifted the secondary tab portion 24 now contacts the head 30 of the secondary tab portion 24 and displaces it towards the lid 14.

Figure 4D:
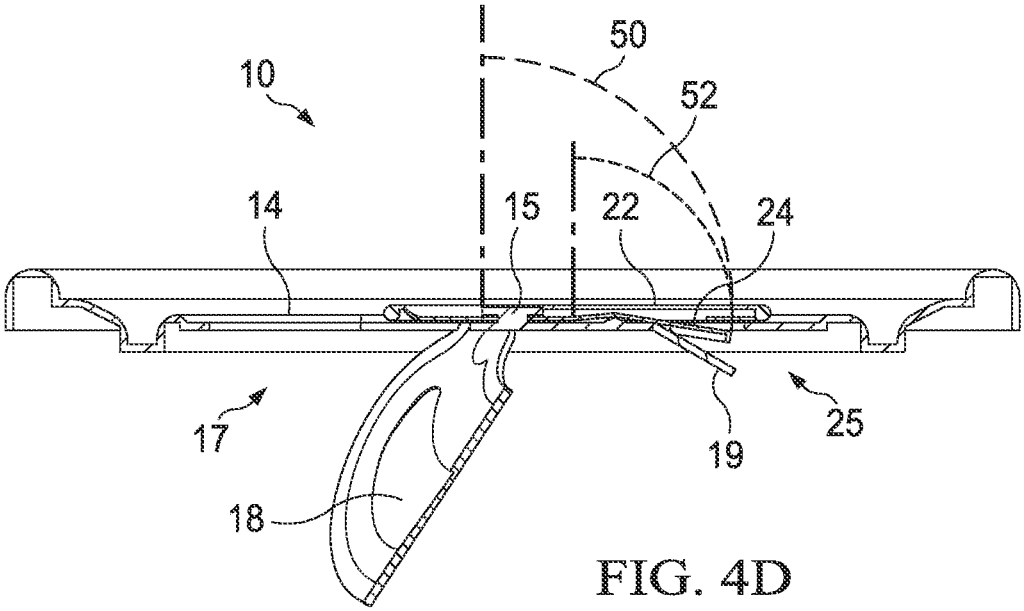

FIG. 4D shows the secondary tab portion 24 having fractured the vent panel 19 away from the lid 14 and displaced the vent panel 19 in towards the interior of the can. Thus, a vent opening 25 is created. Some elastic deflection is expected such that the secondary tab 24 portion displaces elastically towards its natural position which may be slightly above the lid 14. The vent opening 25 is sufficient to allow air into the can 16 as the beverage is poured or consumed from the opening 17.

The foregoing describes only some embodiments of the invention(s), and alterations, modifications, additions and/or changes can be made thereto without departing from the scope and spirit of the disclosed embodiments, the embodiments being illustrative and not restrictive.

Furthermore, the present invention has been described in connection with what are presently considered to be the most practical and preferred embodiments, but it is to be understood that the invention is not to be limited to the disclosed embodiments. On the contrary, the invention is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A tab for a double opening beverage can lid system, comprising:

a primary tab portion configured to open a primary opening of a can lid, the primary tab portion having an inner perimeter and an outer perimeter;

a secondary tab portion disposed at least partially within the inner perimeter and being configured to open a secondary opening of the can lid;

a rivet hole for attaching the primary tab portion and the secondary tab portion to the can lid and being disposed opposite a rear edge of the primary tab portion; and a shelf extending from and bent around the rear edge of the primary tab portion, the shelf blocking at least part of the secondary tab portion from contacting the can lid.

2. The tab of claim 1 wherein the primary tab portion, the secondary tab portion, and the shelf are formed from a same sheet of material having a top surface and an opposite bottom surface, the bottom surface of the shelf facing the secondary tab portion.

3. The tab of claim 1 wherein the shelf defines a notch.

4. The tab of claim 1 wherein the secondary tab portion comprises a head.

5. The tab of claim 4 wherein the secondary tab portion includes a strap connecting the secondary tab portion to the primary tab portion.

6. The tab of claim 1 further comprising a tab score proximate the rivet hole to allow separation of the primary tab portion from the secondary tab portion.

7. The tab of claim 6 wherein the secondary tab portion is configured to remain attached to the can lid upon the separation of the primary tab portion along the tab score.

8. The tab of claim 1 wherein the secondary tab portion comprises a head having a contactor configured to concentrate a downward force on a vent panel to fracture the vent panel along a vent score to form the secondary opening.

9. The tab of claim 8 wherein a skirt extends from the head and is configured to depress the vent panel below the can lid and into a can, the contactor disposed at a center of and extending downward from the skirt.

10. The tab of claim 9 wherein a side contactor extends downward from the skirt and is disposed about 90° from the contactor.

11. A double opening can lid system, comprising:

a can lid comprising a pour panel associated with a pour opening and a vent panel associated with a vent opening;

a tab attached to the can lid, the tab comprising:

a primary tab portion configured to open the pour opening;

a secondary tab portion configured to open the vent opening;

a rivet hole for attaching the primary tab portion and the secondary tab portion to the can lid; and a shelf bent about 180° around a rear edge of the primary tab portion, the shelf blocking at least a portion of the secondary tab portion from contacting the vent panel.

12. The system of claim 11 wherein lifting the tab causes the primary tab portion to rotate together with the secondary tab portion.

13. The system of claim 12 further comprising a rivet received through the rivet hole, a pivot point of the secondary tab portion being on a same side of the rivet as a head of the secondary tab portion, and a pivot point of the primary tab portion being opposite the rivet from the head of the secondary tab portion.

14. The system of claim 11 wherein the secondary tab portion comprises a head having a contactor configured to concentrate a downward force on the vent panel to fracture the vent panel along a vent score to form the vent opening.

15. The system of claim 14 wherein a skirt extends from the head and is configured to depress the vent panel below the can lid and into a can, the contactor disposed at a center of and extending downward from the skirt.

16. The system of claim 11 wherein lifting the primary tab portion beyond a release angle causes the secondary tab portion to release from the shelf.

17. The system of claim 16 wherein the shelf defines a notch.

18. The system of claim 17 wherein the release angle is between 15° and 35°.

19. The system of claim 18 wherein the release angle is between 22° and 27°.

* * * * *